US006747232B1

(12) United States Patent
Drexler et al.

(10) Patent No.: US 6,747,232 B1
(45) Date of Patent: Jun. 8, 2004

(54) VACUUM CONTACTOR

(75) Inventors: Johann Drexler, Schwandorf (DE); Markus Kropp, Warmsen (DE); Bardo Koppmann, Kaltenbrunn (DE); Markus Meier, Rieden (DE); Norbert Mitlmeier, Ursensollen (DE)

(73) Assignee: Siemens Aktiengesellschaft, Munich (DE)

( * ) Notice: Subject to any disclaimer, the term of this patent is extended or adjusted under 35 U.S.C. 154(b) by 36 days.

(21) Appl. No.: 10/089,893

(22) PCT Filed: Oct. 5, 2000

(86) PCT No.: PCT/DE00/03504

§ 371 (c)(1),
(2), (4) Date: Jun. 21, 2002

(87) PCT Pub. No.: WO01/26127

PCT Pub. Date: Apr. 12, 2001

(30) Foreign Application Priority Data

Oct. 5, 1999 (DE) ..... 199 47 836

(51) Int. Cl.[7] ..... H01H 33/28

(52) U.S. Cl. ..... 218/120; 218/84; 218/140; 218/154

(58) Field of Search ..... 218/118, 120, 218/7, 14, 78, 84, 92, 94, 129, 140, 141, 142, 153, 154

(56) References Cited

U.S. PATENT DOCUMENTS

| | | | | |
|---|---|---|---|---|
| 6,020,567 A | * | 2/2000 | Ishikawa et al. | 218/154 |
| 6,156,989 A | * | 12/2000 | Miller et al. | 218/120 |
| 6,373,675 B1 | * | 4/2002 | Yamazaki et al. | 218/120 |

FOREIGN PATENT DOCUMENTS

| | | |
|---|---|---|
| CH | 169467 | 5/1934 |
| DE | 3218907 A1 | 11/1983 |
| GB | 1 432 372 | 4/1976 |
| JP | 07211202 | 8/1995 |

* cited by examiner

*Primary Examiner*—Elvin Enad
*Assistant Examiner*—M. Fishman
(74) *Attorney, Agent, or Firm*—Harness, Dickey & Pierce, P.L.C.

(57) ABSTRACT

In a vacuum contactor, the armature is initially deflected from an armature rest position through an initial movement distance, and then through a driving movement distance to an armature operating position when a pull-in current is applied to a drive coil. An operating element is deflected from an element rest position to an element operating position by the armature only while the latter is passing through the driving movement distance. This makes it possible to achieve a good tripping characteristic of the vacuum contractor.

20 Claims, 2 Drawing Sheets

VACUUM CONTACTOR

This application is the national phase under 35 U.S.C. § 371 of PCT International Application No PCT/DE00/03504 which has an International filing date of Oct. 5, 2000, which designated the United States of America, the entire contents of which are hereby incorporated by reference.

FIELD OF THE INVENTION

The present invention generally relates to a vacuum contactor. Preferably, it relates to one including a contactor housing, a drive coil, an armature, an operating element and at least one vacuum contact. Even more preferably, the drive coil deflects the armature from an armature rest position to an armature operating position when a pull-in current is applied. The deflection of the armature then causes the operating element to be deflected from an element rest position to an element operating position. Finally, the deflection of the operating element results in closing of the at least one vacuum contact.

BACKGROUND OF THE INVENTION

CH-A-169 467 discloses a vacuum contactor having a contactor housing, a drive coil, an armature, an operating element and at least one vacuum contact:

- with the drive coil deflecting the armature from an armature rest position to an armature operating position when a pull-in current is applied,
- with the deflection of the armature causing the operating element to be deflected from an element rest position to an element operating position,
- with the deflection of the operating element resulting in opening of the at least one vacuum contact,
- with, when the armature is deflected from the armature rest position to the armature operating position, the armature first of all passing through an initial movement distance, and then passing through a driving movement distance, and
- with the operating element being deflected by the armature only while the latter is passing through the driving movement distance GB 1 432 372 A discloses an air contactor having a contactor housing a drive coil, an armature, an operating element and at least one contact

- with the drive coil deflecting the armature from an armature rest position to an armature operating position when a pull-in current is applied.
- with the deflection of the armature causing the operating element to be deflected from an element rest position to an element operating position.
- with the deflection of the operating element resulting in closing of the at least one contact,
- with, when the armature is deflected from the armature rest position to the armature operating position, the armature first of all passing through an initial movement distance, followed by a driving movement distance, and
- with the operating element being deflected by the armature only while the latter is passing through the driving movement distance.

In contactors, the armature and the operating element, together with the armature, are generally deflected against a spring force when the pull-in current is applied to the drive coil. The spring force thus acts in the direction of the armature rest position and of the element rest position. This spring force must be overcome by the pull-in force which the drive coil exerts on the armature as a result of the pull-in current. The pull-in force is dependent on the pull-in current, which is in turn dependent on the supply voltage that is supplied to the drive coil.

Both the pull-in force and the spring force in the opposite direction vary along the distance through which the armature and the operating element are deflected. If the contactor is not well designed, it is thus possible for a situation to occur in which, if the supply voltage is too low, although the armature and the operating element are deflected from their rest positions, the armature and the operating element are not deflected to their operating positions, however. In a case such as this, the armature and operating element either remain stuck in an intermediate position, or a contact which is operated by the operating element is only operated without a pressure. Depending on the duration of this state, this can lead to high wear, and generally also to damage, while in the extreme case, it can even lead to destruction of the contactor.

In the case of air contactors, that is to say in contactors whose contacts are surrounded by air, it is possible to design these contactors such that the armature and operating element are either not deflected at all from their rest positions or else are moved completely to their operating positions. Such a contactor characteristic is referred to as a tripping characteristic.

Vacuum contactors require a greater spring force in the opposite direction than air contactors. This is because the vacuum pressure forces which would initiate autonomous operation of the contacts must be overcome. Until now, for vacuum contactors, it has been regarded as being impossible to achieve a tripping characteristic just on the basis of the mechanical/electrical design of the contactor. Vacuum contactors according to the prior art therefore either do not have a tripping characteristic or else drive electronics are connected upstream of the drive coil and apply the supply voltage to the drive coil only when the supply voltage is high enough to ensure that the armature and operating element will reliably be moved to the operating positions.

SUMMARY OF THE INVENTION

In an embodiment of the present invention, if the vacuum contactor is designed in a suitable manner, it is possible to achieve a tripping characteristic even without any upstream drive electronics. A vacuum contactor has been created, in one embodiment of the present application, in which the operating element always either remains in the element rest position or is deflected completely to the element operating position when a current that is less than the pull-in current is applied to the drive coil.

This can occur because, for example, the force which needs to be overcome along the initial movement distance can be chosen independently of the contact arrangement. In particular, it can be chosen independently of the fact that vacuum contacts are being operated. This allows a tripping characteristic to be achieved, if the vacuum contactor is designed in a suitable manner.

In vacuum contactors, arcs can be quenched even with small contact openings. Vacuum contactors therefore generally have shorter switching movements than air contactors. The dimensions that are known for air contactors can thus be used, provided the sum of the initial movement distance and the driving movement distance correspond to the contact movement distance of an air contactor. In practice, this corresponds to the ratio of the initial movement distance to the driving movement distance being between 1:3 and 3:1. In general, the ratio of the initial movement distance to the driving movement distance is between 2:3 and 3:2.

As already mentioned, the armature can be deflected against an initial movement force while it is passing through the initial movement distance, and against a driving force while it is passing through the driving movement distance. A tripping characteristic can be achieved in a particularly highly reliable manner if the initial movement force is less than the driving force. In practice, this normally means that the ratio of the initial movement force to the driving force is between 1:10 and 1:2, in particular between 1:5 and 1:4.

The physical design of the vacuum contactor can be particularly simple if the initial movement force is applied by an initial movement spring device, and the driving force is applied by a driving spring device, the initial movement spring device is supported firstly on the armature and secondly on the operating element, and the driving spring device is supported firstly on the operating element and secondly on the contactor housing.

If the operating element has a stop, against which the armature is moved when it is deflected from the armature rest position, the initial movement distance can be defined exactly in a particularly simple manner.

BRIEF DESCRIPTION OF THE DRAWINGS

Further advantages and details can be found in the following description of an exemplary embodiment. In this case, illustrated in outline form.

DETAILED DESCRIPTION OF THE PREFERRED EMBODIMENTS

Figure 1:
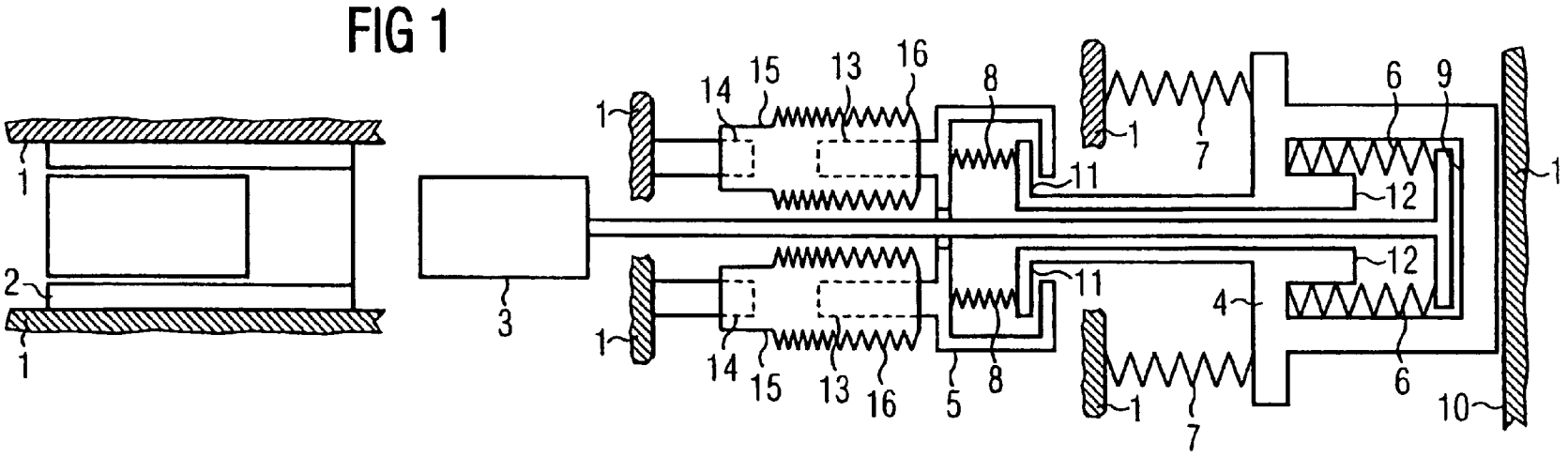
FIG. 1 shows a vacuum contactor in the unoperated state.

FIG. 1 shows a vacuum contactor with a contactor housing 1. Only part of the contactor housing 1 is shown in FIG. 1. A drive coil 2 is mounted rigidly in the contactor housing 1. An armature 3, an operating element 4 and a contact link 5 are also mounted, such that they can move, in the contactor housing 1.

The contactor has an initial movement spring device 6, a driving spring device 7 and a contact-making spring device 8. According to the exemplary embodiment, the spring devices 6–8 are in the form of compression spring devices. However, they could also be of other different configurations, for example they could be in the form of rotary spring devices, etc.

The initial movement spring device 6 is supported firstly on the armature 3 and secondly on the operating element 4. The driving spring device 7 is supported firstly on the operating element 4 and secondly on the contactor housing 1. The contact-making spring device 8 is supported firstly on the operating element 4 and secondly on the contact link 5.

When no current is applied to the drive coil 2, the initial movement spring device 6 presses the armature 3 against an upper operating element stop 9. The driving spring device 7 presses the operating element 4 against a housing stop 10. The contact-making spring device 8 presses the contact link 5 against a contact link stop 11. The armature 3 is thus in an armature rest position AR, the operating element 4 is in an element rest position ER, and the contact link 5 is in a link rest position. This position is shown in FIG. 1.

Figure 2:
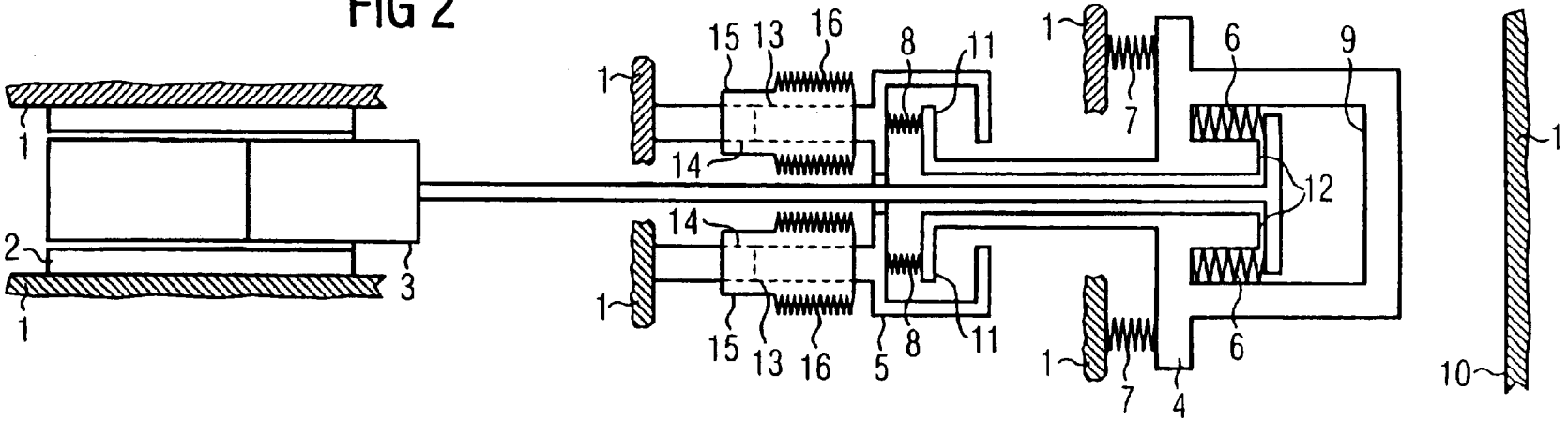
FIG. 2 shows the vacuum contactor from FIG. 1 in the operated state.

If, in contrast and as shown in FIG. 2, a pull-in current IA is applied to the drive coil 2, the armature 3 is deflected from its armature rest position AR to an armature operating position AB.

An initial movement force FV is applied by the initial movement spring device 6 in the opposite direction to that in which the armature 3 moves. This force is less than a driving force FM, which is likewise in the opposite direction to the direction in which the armature 3 moves and is applied by the driving spring device 7. The armature 3 is thus first of all deflected through an initial movement distance sV by the drive coil 2. For the armature 3 to pass through the initial movement distance sV, the drive coil 2 has to overcome only the initial movement force FV. Since the initial movement force FV is less than the driving force FM, the operating element 4 is not deflected while the armature 3 is passing through the initial movement distance sV, and remains in its element rest position ER.

At the end of the initial movement distance sV, the armature 3 is moved against a lower operating element stop 12, which is arranged on the operating element 4. The movement of the armature 3 against the lower operating element stop 12 means that the further deflection of the armature 3 to an armature operating position AB also results in the operating element 4 being deflected to an element operating position EB. The driving force FM must be overcome while passing through the driving movement distance sM, which is defined by the operating element 4 being driven.

The deflection of the operating element 4 results in contact pieces 13 on the contact link 5 being lowered, as illustrated in FIG. 2, onto mating contacts 14, which are arranged fixed in the contactor housing 1. The operating element 4 is then also deflected somewhat further, so that, during the last section of the movement through the driving movement distance sM, referred to as the contact-making movement distance sD in the following text, it is necessary to overcome the driving force FM plus a contact-making force FD which is applied by the contact-making spring device 8.

The deflection of the operating element 4 thus results in operation of a contact which is formed firstly by the contact link 5 together with the contact pieces 13 and secondly by the mating contacts 14. As can be seen from FIGS. 1 and 2, the contact pieces 13 are lowered in vacuum containers 15 onto the mating contacts 14. The vacuum containers 15 in this case have at least one subsection 16 within which their lengths are variable. Since the contact pieces 13 and the mating contacts 14 are arranged in vacuum containers 15, the contact is a vacuum contact. The contactor is thus a vacuum contactor.

Figure 3:
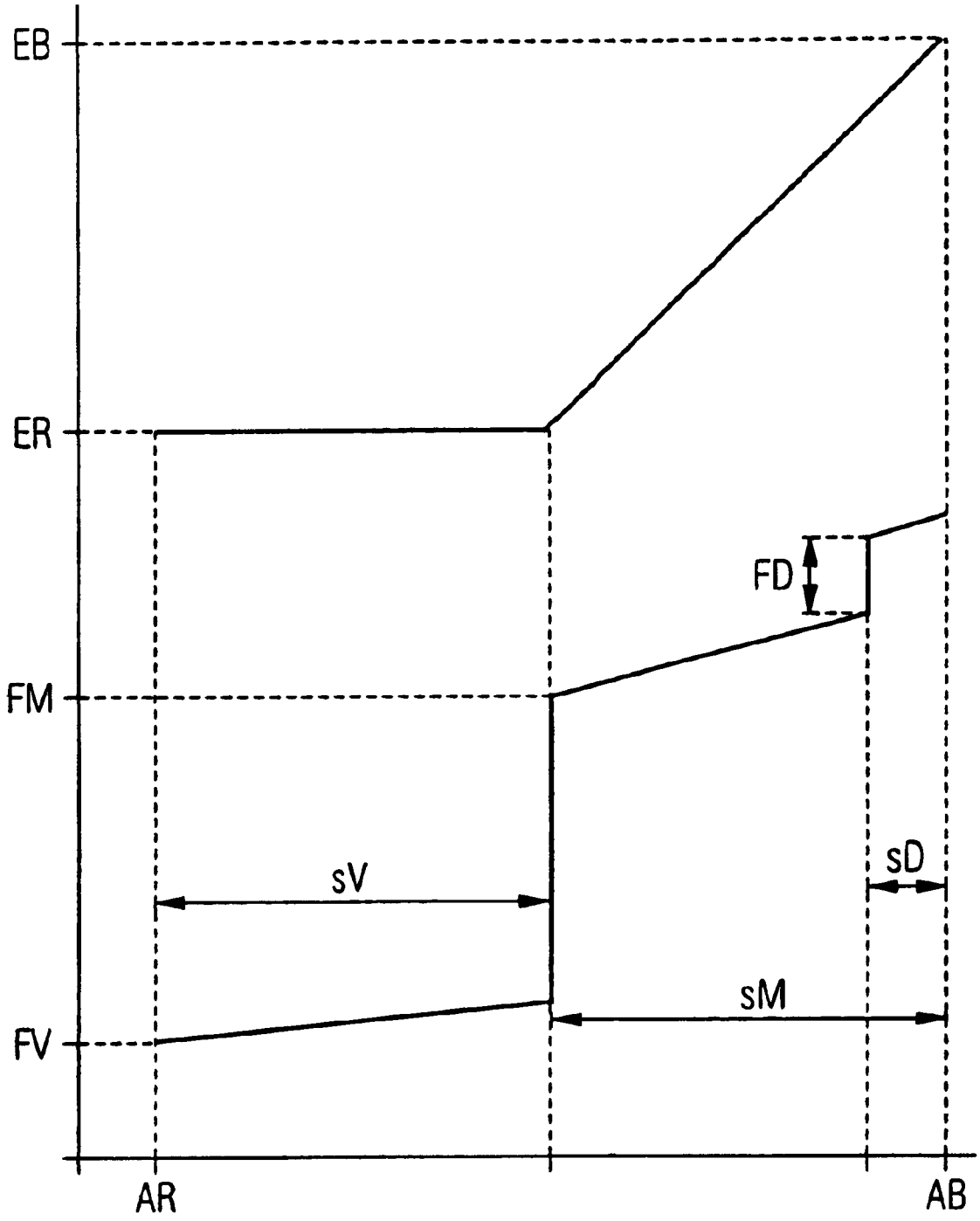
FIG. 3 shows a force and movement profile plotted against the armature movement distance.

FIG. 3 now shows, initially schematically, the force profile which the drive coil 2 has to overcome on the basis of the pull-in current IA. Only the initial movement force FV, which increases slightly along the initial movement distance sV, must be overcome while passing through the initial movement distance sV. During the driving movement distance sM, on the other hand, the driving force FM must be overcome, and this likewise increases along the driving movement distance sM. In fact, the sum of the driving force FM and the contact-making force FD must be overcome during the contact-making movement distance sD.

The initial movement force FV is less than the driving force FM. As a rule, it is 10% to 50% of the driving force FM. The ratio of the initial movement force FV to the driving force FM is thus generally 1:10 to 1:2. The initial movement force FV is preferably between 20% and 25% of the diving force FM and the ratio is thus preferably between 1:5 and 1:4.

It can also be seen from FIG. 3 that the operating element 4 is deflected by the armature 3 only while the latter is passing through the driving movement distance sM. As a rule, the initial movement distance sV is 25% to 75% of the overall movement distance that the armature 3 passes through. In general, it is between 40% and 60% of the total movement distance. The ratio of the initial movement distance sV to the driving movement distance sM is thus generally between 1:3 and 3:1, and is normally between 2:3 and 3:2.

The driving force FM is governed essentially by the dimensions of the vacuum contact—or the vacuum contacts if there are a number of contacts to be switched. The initial movement force FV can, in contrast, in principle be chosen as required. Thus, in particular, it is possible to design the initial movement force FV to be similar to that in an air contactor with the same rating.

The driving movement distance sM is likewise governed essentially by the dimensions of the vacuum contactor. The initial movement distance sV can once again be chosen as required. In particular, the initial movement distance sV can be chosen such that the sum of the initial movement distance sV and of the driving movement distance sM corresponds to the movement distance through which the armature and the operating element of a comparable air contactor are moved. The drive coil 2 can thus be designed in the same way as for a comparable air contactor. This makes it possible, in particular, to achieve a vacuum contactor with a good tripping characteristic.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A vacuum contactor, comprising:

a contactor housing;

a drive coil;

an armature;

an operating element; and at least one vacuum contact, wherein the drive coil is adapted to deflect the armature from an armature rest position to an armature operating position when a pull-in current is applied, wherein the deflection of the armature is adapted to cause the operating element to be deflected from an element rest position to an element operating position, wherein the deflection of the operating element is adapted to result in closing of the at least one vacuum contact, wherein when the armature is deflected from the armature rest position to the armature operating position, the armature is adapted to first pass through an initial movement distance and is then adapted to pass through a driving movement distance, with the operating element being deflected by the armature only while the armature is passing through the driving movement distance, and wherein the vacuum contactor is adapted such that, for any current less than the pull-in current, the operating element either remains in the element rest position or is deflected completely to the element operating position, when the current is applied to the drive coil.

2. The vacuum contact as claimed in claim 1, wherein the ratio of the initial movement distance to the driving movement distance is between 1:3 and 3:1.

3. The vacuum contactor as claimed in claim 1, wherein the ratio of the initial movement distance to the driving movement distance is between 2:3 and 3:2.

4. The vacuum contactor as claimed in claim 1, wherein the armature is deflected by the drive coil against an initial movement force while it is passing through the initial movement distance, and against a driving force while it is passing through the driving movement distance, and wherein the initial movement force is less than the driving force.

5. The vacuum contactor as claimed in claim 4, wherein the ratio of the initial movement force to the driving force is between 1:10 and 1:2.

6. The vacuum contact as claimed in claim 4, wherein the ratio of the initial movement force to the driving force is between 1:5 and 1:4.

7. The vacuum contactor as claimed in claim 4, wherein the initial movement force is applied by an initial movement spring device, and the driving force is applied by a driving spring device, wherein the initial movement spring device is supported firstly on the armature and secondly on the operating element, and wherein the driving spring device is supported firstly on the operating element and secondly on the contactor housing.

8. The vacuum contactor as claimed in claim 1, wherein the operating element includes a stop, against which the armature is moved when it is deflected from the armature rest position.

9. The vacuum contactor as claimed in claim 2, wherein the armature is deflected by the drive coil against an initial movement force while it is passing through the initial movement distance, and against a driving force while it is passing through the driving movement distance, and wherein the initial movement force is less than the driving force.

10. The vacuum contactor as claimed in claim 9, wherein the ratio of the initial movement force to the driving force is between 1:10 and 1:2.

11. The vacuum contact as claimed in claim 9, wherein the ratio of the initial movement force to the driving force is between 1:5 and 1:4.

12. The vacuum contactor as claimed in claim 3, wherein the armature is deflected by the drive coil against an initial movement force while it is passing through the initial movement distance, and against a driving force while it is passing through the driving movement distance, and wherein the initial movement force is less than the driving force.

13. The vacuum contactor as claimed in claim 12, wherein the ratio of the initial movement force to the driving force is between 1:10 and 1:2.

14. The vacuum contact as claimed in claim 12, wherein the ratio of the initial movement force to the driving force is between 1:5 and 1:4.

15. The vacuum contactor as claimed in claim 5, wherein the initial movement force is applied by an initial movement spring device, and the driving force is applied by a driving spring device, wherein the initial movement spring device is supported firstly on the armature and secondly on the operating element, and wherein the driving spring device is supported firstly on the operating element and secondly on the contactor housing.

16. The vacuum contactor as claimed in claim 6, wherein the initial movement force is applied by an initial movement spring device, and the driving force is applied by a driving spring device, wherein the initial movement spring device is supported firstly on the armature and secondly on the operating element, and wherein the driving spring device is supported firstly on the operating element and secondly on the contactor housing.

17. The vacuum contactor as claimed in claim 2, wherein the operating element includes a stop, against which the armature is moved when it is deflected from the armature rest position.

18. The vacuum contactor as claimed in claim 4, wherein the operating element includes a stop, against which the armature is moved when it is deflected from the armature rest position.

19. A method of operating a vacuum contactor including a drive coil, an armature, an operating element, and at least one vacuum contact, comprising:

applying a pull-in current to the drive coil to deflect the armature from an armature rest position to an armature operating position;

causing, from the deflection of the armature, the operating element to be deflected from an element rest position to an element operating position;

causing, from the deflection of the operating element, closing of the at least one vacuum contact; and causing, when the armature is deflected from the armature rest position to the armature operating position, the armature to first pass through an initial movement distance and then pass through a driving movement distance, with the operating element being deflected by the armature only while the armature is passing through the driving movement distance, and wherein the vacuum contactor is adapted such that, for any current less than the pull-in current, the operating element either remains in the element rest position or is deflected completely to the element operating position, when the current is applied to the drive coil.

20. An apparatus, comprising:

a vacuum contactor including a drive coil, an armature, an operating element, and at least one vacuum contact; and means for applying a pull-in current to the drive coil to detect the armature from an armature rest position to an armature operating position, wherein, from the deflection of the armature, the operating element is adapted to be deflected from an element rest position to an element operating position, wherein, from the deflection of the operating element, the at least one vacuum contact is adapted to be closed, wherein, when the armature is deflected from the armature rest position to the armature operating position, the armature is adapted to first pass through an initial movement distance and then pass through a driving movement distance, with the operating element being deflected by the armature only while the armature is passing through the driving movement distance, and wherein the vacuum contactor is adapted such that, for any current less than the pull-in current, the operating element either remains in the element rest position or is deflected completely to the element operating position, when the current is applied to the drive coil.

* * * * *